US008360613B2

(12) United States Patent
Little, Jr.

(10) Patent No.: US 8,360,613 B2
(45) Date of Patent: Jan. 29, 2013

(54) LIGHT FEATURE

(75) Inventor: William D. Little, Jr., Corinth, TX (US)

(73) Assignee: Aphos Lighting LLC, Carrollton, TX (US)

( * ) Notice: Subject to any disclaimer, the term of this patent is extended or adjusted under 35 U.S.C. 154(b) by 329 days.

(21) Appl. No.: 12/870,772

(22) Filed: Aug. 27, 2010

(65) Prior Publication Data

US 2011/0013402 A1 Jan. 20, 2011

Related U.S. Application Data

(63) Continuation-in-part of application No. 12/752,105, filed on Mar. 31, 2010.

(60) Provisional application No. 61/225,715, filed on Jul. 15, 2009.

(51) Int. Cl.
*F21V 29/00* (2006.01)

(52) U.S. Cl. ..... 362/294; 362/249.02; 362/218

(58) Field of Classification Search ..... 362/147, 362/153.1, 218, 249.02, 294
See application file for complete search history.

(56) References Cited

U.S. PATENT DOCUMENTS

| | | | |
|---|---|---|---|
| 2,017,716 | A | 10/1935 | Halvorson |
| D99,661 | S | 5/1936 | Gosling |
| D119,792 | S | 4/1940 | Pieper |
| D125,468 | S | 2/1941 | Dreyfuss |
| 2,715,449 | A | 8/1955 | Lemmerman et al. |
| D191,062 | S | 8/1961 | Gross |
| D198,183 | S | 5/1964 | Akely |
| D204,558 | S | 4/1966 | Zeitz |
| D205,302 | S | 7/1966 | Wince |
| D323,897 | S | 2/1992 | Compton |
| D401,001 | S | 11/1998 | Herst et al. |
| D504,538 | S | 4/2005 | Waldmann |
| D556,935 | S | 12/2007 | Quioque et al. |
| D576,330 | S | 9/2008 | Ruud et al. |
| 7,458,706 | B1 | 12/2008 | Liu et al. |
| D600,847 | S | 9/2009 | Wung et al. |
| D603,077 | S | 10/2009 | Kinnune et al. |
| D605,328 | S | 12/2009 | Wang et al. |
| D607,598 | S | 1/2010 | Xiao et al. |
| D613,885 | S | 4/2010 | Lodhie |
| D619,747 | S | 7/2010 | Jung |
| D619,749 | S | 7/2010 | Jong |
| 7,766,513 | B2 | 8/2010 | Zhang et al. |
| D627,093 | S | 11/2010 | Shiau et al. |
| D631,999 | S | 2/2011 | Little et al. |

(Continued)

FOREIGN PATENT DOCUMENTS

| | | | |
|---|---|---|---|
| JP | 2004095665 | A | 3/2004 |
| JP | 2009016674 | A | 1/2009 |

(Continued)

*Primary Examiner* — David V Bruce
(74) *Attorney, Agent, or Firm* — Andy M. Han; Han IP Law PLLC

(57) ABSTRACT

A lighting apparatus includes a light source module and a heat dissipation module. The light source module emits light and generates heat. The heat dissipation module dissipates at least a portion of the heat, and includes a base portion to which the light source module is physically coupled. The heat dissipation module also includes a plurality of heat dissipation fins. At least two of the fins that are immediately adjacent to one another form an air channel having a first opening and a second opening between the at least two of the fins. The air channel has a generally decreasing cross-sectional area with respect to air rising up the air channel in a generally vertical direction with respect to a horizontal plane as the air enters the air channel through the first opening and exits the air channel through the second opening.

20 Claims, 18 Drawing Sheets

U.S. PATENT DOCUMENTS

| | | | |
|---|---|---|---|
| D632,000 | S | 2/2011 | Little et al. |
| 2003/0209342 | A1 | 11/2003 | Hsin et al. |
| 2005/0280992 | A1 | 12/2005 | Carter et al. |
| 2007/0183148 | A1 | 8/2007 | Mayfield, III et al. |
| 2008/0013322 | A1 | 1/2008 | Ohkawa |
| 2008/0080189 | A1 | 4/2008 | Wang |
| 2008/0302509 | A1 | 12/2008 | Chen et al. |
| 2009/0129075 | A1 | 5/2009 | Shuai et al. |
| 2009/0141494 | A1 | 6/2009 | Zhang et al. |
| 2009/0190350 | A1 | 7/2009 | Tseng et al. |
| 2009/0225555 | A1 | 9/2009 | Ghim et al. |
| 2009/0244927 | A1 | 10/2009 | Liu et al. |
| 2009/0251898 | A1 | 10/2009 | Kinnune et al. |
| 2009/0290352 | A1 | 11/2009 | Wu et al. |
| 2009/0323331 | A1 | 12/2009 | Louh |
| 2010/0149809 | A1 | 6/2010 | Ruud et al. |
| 2011/0044043 | A1* | 2/2011 | Wong ..... 362/249.02 |

FOREIGN PATENT DOCUMENTS

| | | | |
|---|---|---|---|
| JP | 2009238734 | A | 10/2009 |
| TW | D126175 | | 11/2008 |
| TW | D128036 | | 3/2009 |
| TW | D129045 | | 6/2009 |
| TW | D129046 | | 6/2009 |
| TW | M359643 | | 6/2009 |
| TW | D133228 | | 2/2010 |
| TW | D133229 | | 2/2010 |
| TW | D133230 | | 2/2010 |
| TW | D134760 | | 5/2010 |
| TW | D135539 | | 6/2010 |

* cited by examiner

LIGHT FEATURE

CROSS-REFERENCE TO RELATED APPLICATION

This application is a continuation-in-part application and claims the priority benefit of U.S. non-provisional application Ser. No. 12/752,105, filed on Mar. 31, 2010, which claims the priority benefit of U.S. provisional application Ser. No. 61/225,712, filed on Jul. 15, 2009. The entirety of the above-mentioned patent applications are hereby incorporated by reference herein and made a part of this specification.

BACKGROUND

1. Technical Field

The present disclosure generally relates to a lighting apparatus, and in particular, to a lighting apparatus having more efficient heat dissipation.

2. Description of Related Art

A light-emitting diode (LED) is a semiconductor device that is fabricated by using a compound of chemical elements selected from the groups III-V, such as GaP, GaAs, and so forth. This kind of semiconductor material has the property of converting electrical energy into light. More specifically, electrons and holes in the semiconductor material are combined to release excessive energy in the form of light when a current is applied to the semiconductor material. Hence, an LED can emit light.

As the light generated by an LED is a form of cold luminescence instead of thermal luminescence or electric discharge luminescence, the lifespan of LED devices is up to one hundred thousand hours. Furthermore, LED devices do not require idling time. LED devices have the advantage of fast response speed (about $10^{-9}$ seconds), compact size, low power consumption, low pollution (mercury-free), high reliability, and the capability for mass production. Hence, the applications of LED devices are fairly extensive. For example, LEDs can be used in large-sized display boards, traffic lights, cell phones, scanners, light sources for fax machines, and so forth.

In recent years, as the brightness and light-emitting efficiency of LEDs are being improved and the mass production of white light LEDs is carried out successfully, white light LEDs are increasingly used in illumination devices, such as indoor and outdoor illuminators. Generally speaking, high-power LEDs tend to encounter a heat dissipation problem. When an LED is operated at an overly high temperature, the brightness of the LED lamp may be reduced and the lifespan of the LED may be shortened. Thus, there is a need for a high-efficiency heat dissipation system for LED lamps.

SUMMARY

The present disclosure provides a lighting apparatus having more efficient heat dissipation.

In one aspect, a lighting apparatus may include a light source module, that emits light and generates heat, and a heat dissipation module that dissipates at least a portion of the heat.

The heat dissipation module may include a base portion to which the light source module is physically coupled as well as a plurality of heat dissipation fins. At least two of the fins that are immediately adjacent to one another may form an air channel having a first opening and a second opening between the at least two of the fins. The air channel may have a generally decreasing cross-sectional area with respect to air rising up the air channel in a generally vertical direction with respect to a horizontal plane as the air enters the air channel through the first opening and exits the air channel through the second opening.

The light source may be physically coupled to the base portion to be at least partially vertically below the heat dissipation module with respect to the horizontal plane. At least a portion of heat generated by the light source may be transferred vertically to at least one of the fins through the base portion.

The light source module may be physically coupled to the heat dissipation module to emit light in an angle that is between a substantially horizontal angle and a substantially vertical angle with respect to the horizontal plane when the lighting apparatus is in operation.

The light source module may be physically coupled to the heat dissipation module to emit light in an angle that is substantially perpendicular to the horizontal plane when the lighting apparatus is in operation.

The light source module may include at least one light-emitting diode (LED).

At least one of the fins may be at least partially curved in shape.

The fins may be configured such that a respective air channel having a respective first opening and a respective second opening is formed between every two immediately adjacent fins and between one of the fins and the base portion. Each air channel may have a generally decreasing cross-sectional area with respect to air rising up the respective air channel as the air enters the respective air channel through the respective first opening and exits the respective air channel through the respective second opening.

The heat dissipation module may have a heat dissipation capacity at least in a range between 8 watts/lb and 10 watts/lb.

The heat dissipation module may be made of aluminium, magnesium, copper, conductive plastic, or a thermally conductive material.

The lighting apparatus may further include a diffuser that diffuses at least a portion of the light emitted by the light source module.

The lighting apparatus may further include a mounting apparatus that facilitates physically coupling the lighting apparatus to a fixture.

The lighting apparatus may further include a guard piece that prevents the light emitted by the light source module from shining toward at least one direction.

In another aspect, a heat dissipation module may include a base portion to which at least a portion of heat generated by a light source is transferred when the light source is physically coupled to the base portion. The heat dissipation module may also include a plurality of heat dissipation fins. At least two of the fins that are immediately adjacent to one another may form an air channel having a first opening and a second opening between the at least two of the fins. The air channel may have a generally decreasing cross-sectional area with respect to air rising up the air channel in a generally vertical direction with respect to a horizontal plane as the air enters the air channel through the first opening and exits the air channel through the second opening.

When the light source is physically coupled to the base portion to be at least partially vertically below the heat dissipation module with respect to the horizontal plane, at least a portion of the heat generated by the light source may be transferred vertically to at least one of the fins through the base portion.

At least one of the fins may be at least partially curved in shape.

The fins may be configured such that a respective air channel having a respective first opening and a respective second opening is formed between every two immediately adjacent fins and between one of the fins and the base portion. Each air channel may have a generally decreasing cross-sectional area with respect to air rising up the respective air channel as the air enters the respective air channel through the respective first opening and exits the respective air channel through the respective second opening.

The heat dissipation module may have a heat dissipation capacity at least in a range between 8 watts/lb and 10 watts/lb.

The heat dissipation module may be made of aluminium, magnesium, copper, conductive plastic, or a thermally conductive material.

In yet another aspect, a lighting apparatus may include a light source module that emits light and generates heat, and a heat dissipation module that dissipates at least a portion of the heat. The heat dissipation module may include a base portion to which the light source module is physically coupled as well as a plurality of heat dissipation fins. The fins may be configured such that: when the light source module is physically coupled to the base portion to be at least partially vertically below the heat dissipation module with respect to a horizontal plane, at least a portion of the heat is transferred vertically to at least one of the fins through the base portion; and at least two of the fins that are immediately adjacent to one another form an air channel having a first opening and a second opening between the at least two of the fins, the air channel having a generally decreasing cross-sectional area with respect to air rising up the air channel in a generally vertical direction with respect to the horizontal plane as the air enters the air channel through the first opening and exits the air channel through the second opening.

A first number of the fins may be on a first primary side of the heat dissipation module and a second number of the fins may be on a second primary side of the heat dissipation module. The light source module may include a first light source and a second light source. The first light source may be physically coupled to the base portion in a position substantially vertically below the first number of the fins with respect to the horizontal plane and the second light source may be physically coupled to the base portion in a position substantially vertically below the second number of the fins with respect to the horizontal plane when the lighting apparatus is in operation.

The light source module may include at least one light-emitting diode (LED).

At least one of the fins may be at least partially curved in shape.

The fins may be configured such that a respective air channel having a respective first opening and a respective second opening is formed between every two immediately adjacent fins and between one of the fins and the base portion. Each air channel may have a generally decreasing cross-sectional area with respect to air rising up the respective air channel as the air enters the respective air channel through the respective first opening and exits the respective air channel through the respective second opening.

The heat dissipation module may have a heat dissipation capacity at least in a range between 8 watts/lb and 10 watts/lb.

Thus, with the proposed design, heat is transferred from the light source to the heat dissipation module via vertical heat transfer as opposed to horizontal heat transfer. Additionally, the heat dissipation fins form air channels that have a decreasing cross-sectional areal as air rises up the air channels. With at least one of the fins curved in shape, the heat-absorbing air is compressed as it rises up the air channels. This causes a spiral effect, or turbulence, in the air to result in enhanced efficiency in cooling.

BRIEF DESCRIPTION OF THE DRAWINGS

The accompanying drawings are included to provide a further understanding of the present disclosure, and are incorporated in and constitute a part of this specification. The drawings illustrate embodiments of the present disclosure and, together with the description, serve to explain the principles of the present disclosure.

DESCRIPTION OF THE EMBODIMENTS

Figure 1:
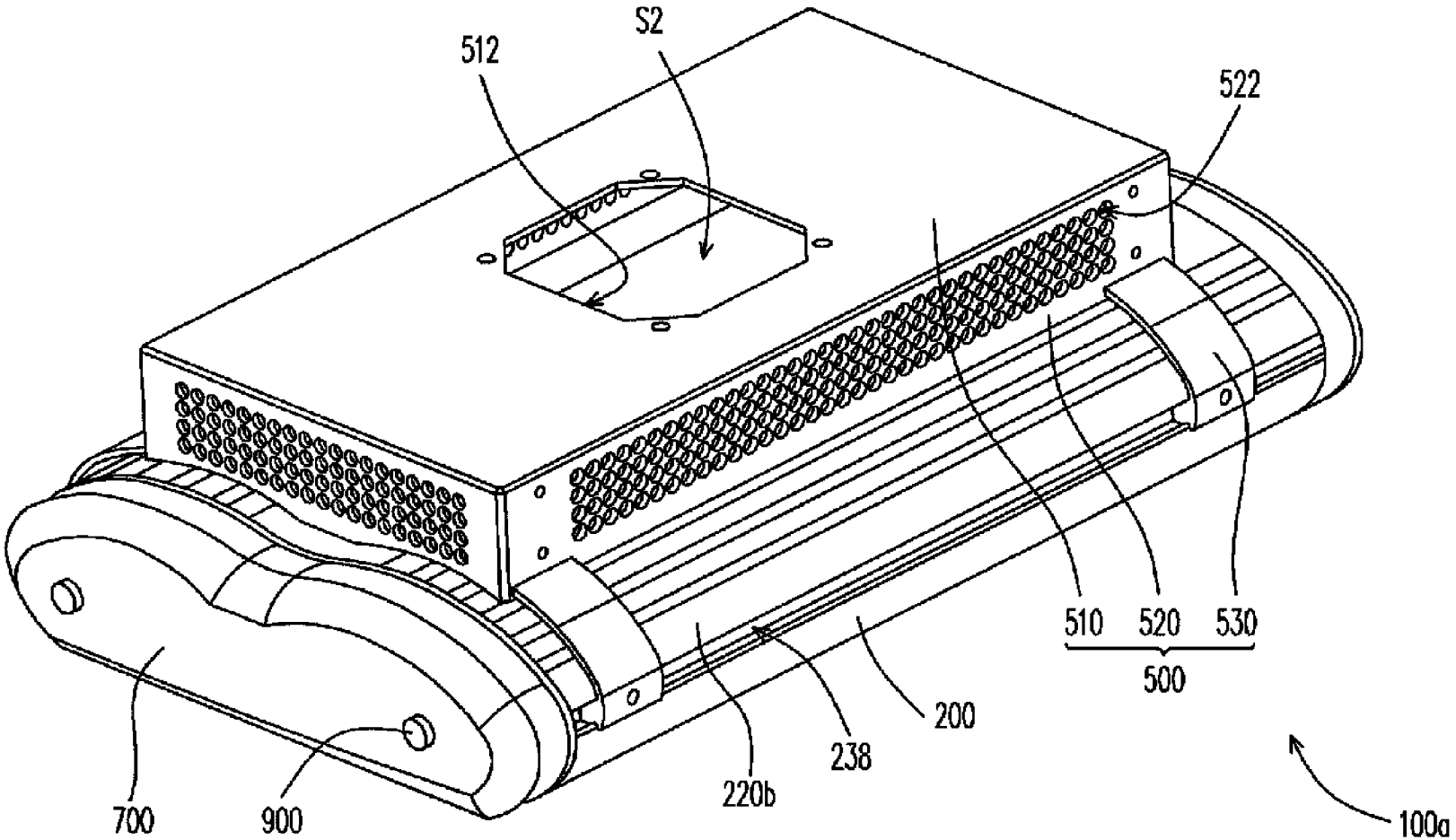
FIG. 1 is a schematic perspective view of a first lighting apparatus according to one embodiment of the present disclosure.

Reference will now be made in detail to the present preferred embodiments of the present disclosure, examples of which are illustrated in the accompanying drawings. Wherever possible, the same reference numbers are used in the drawings and the description to refer to the same or like parts.

Figure 2A:
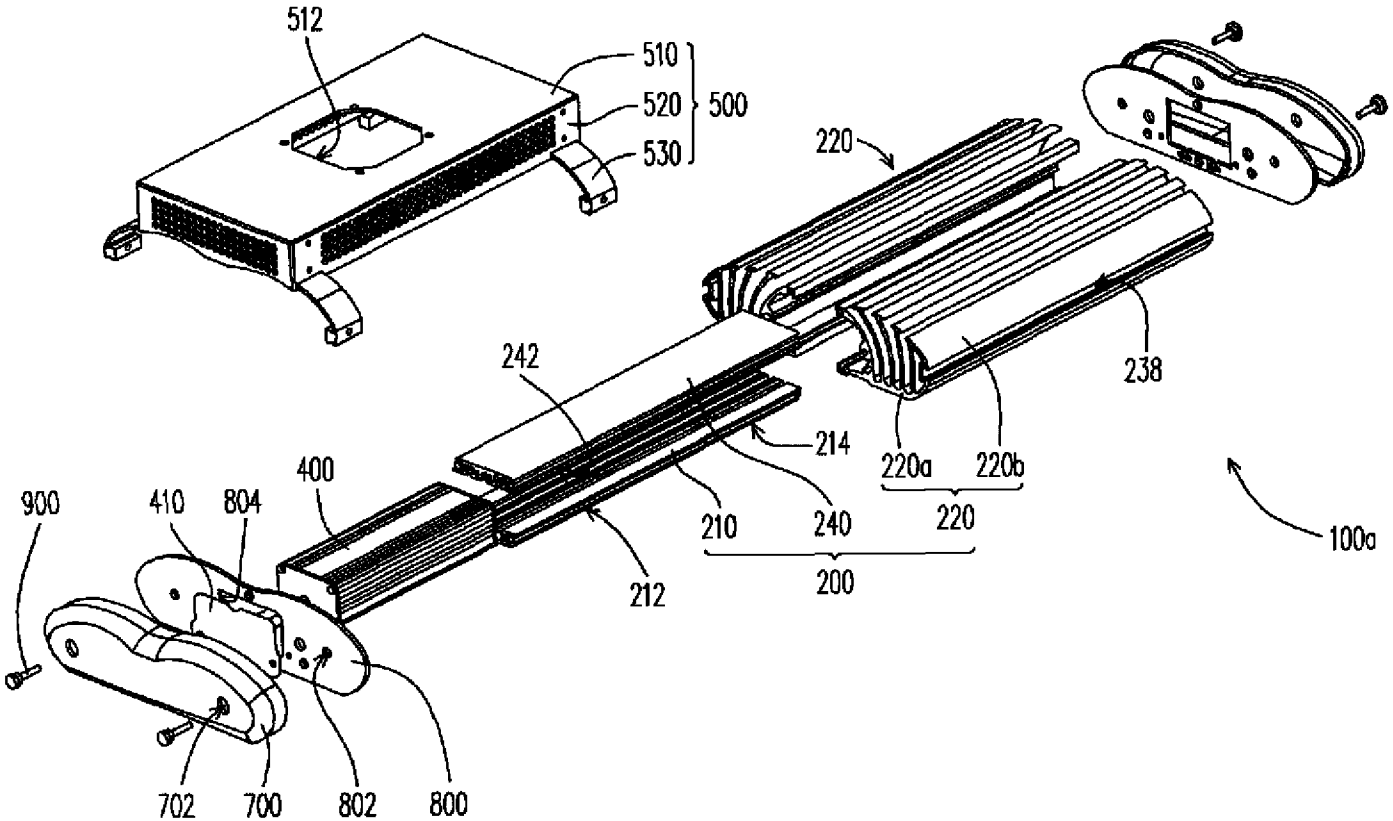
FIG. 2A is a schematic exploded view of the first lighting apparatus in FIG. 1.
Figure 2B:
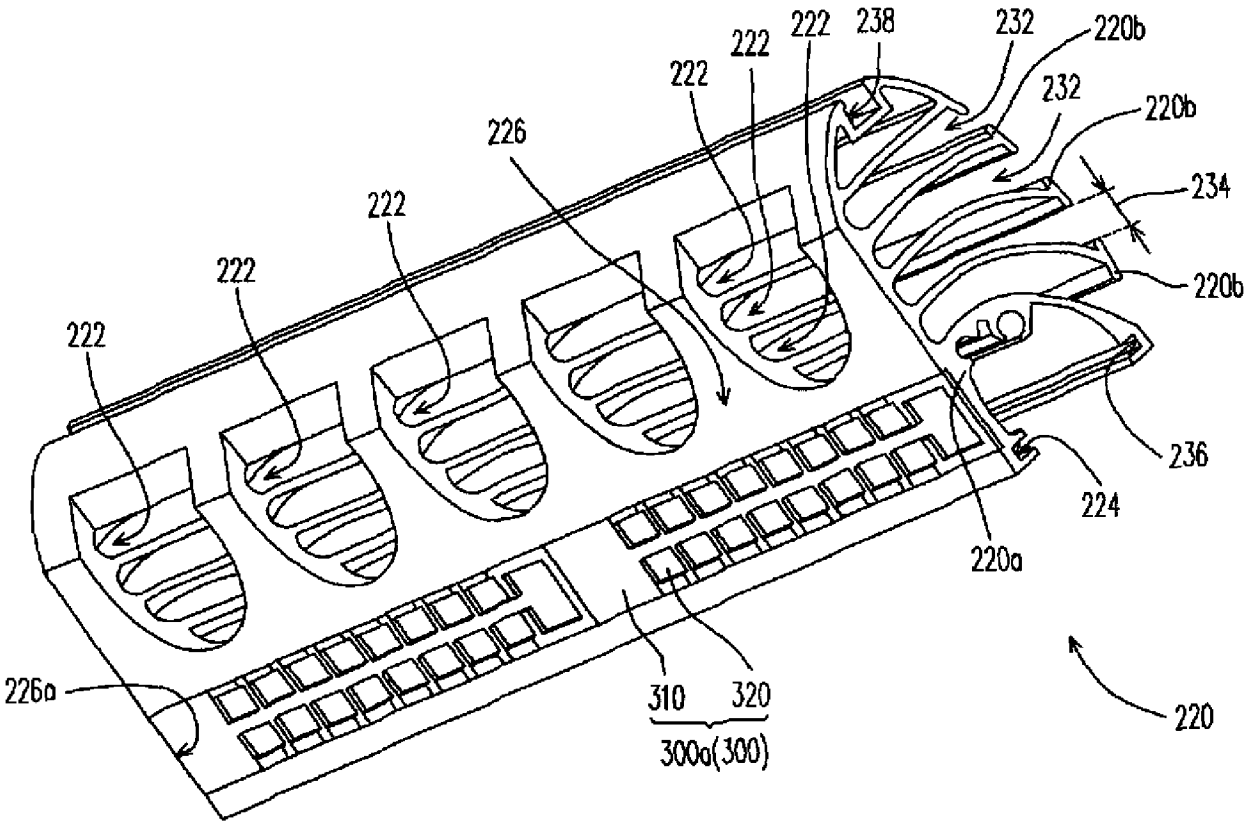
FIG. 2B is a partially enlarged view of the heat sink of the first lighting apparatus in FIG. 2A.
Figure 2C:
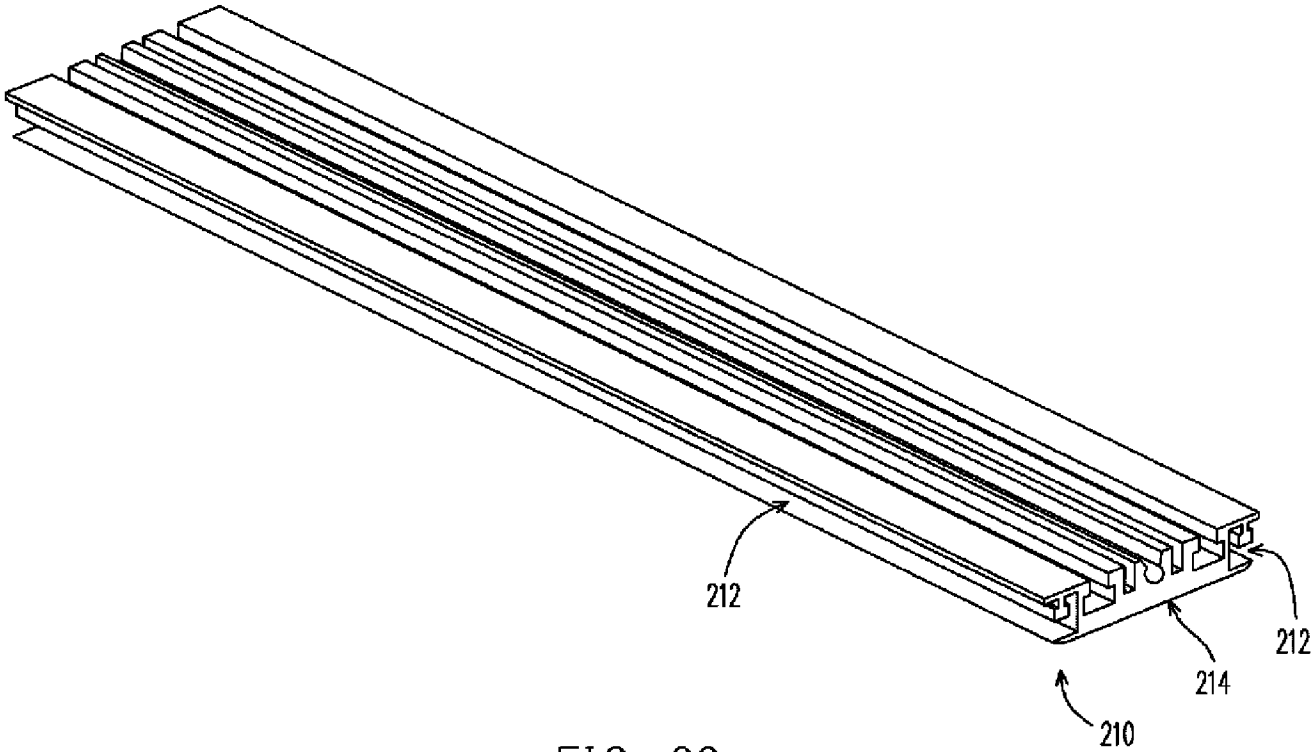
FIG. 2C is a partially enlarged view of the first connection element of the first lighting apparatus in FIG. 2A.
Figure 2D:
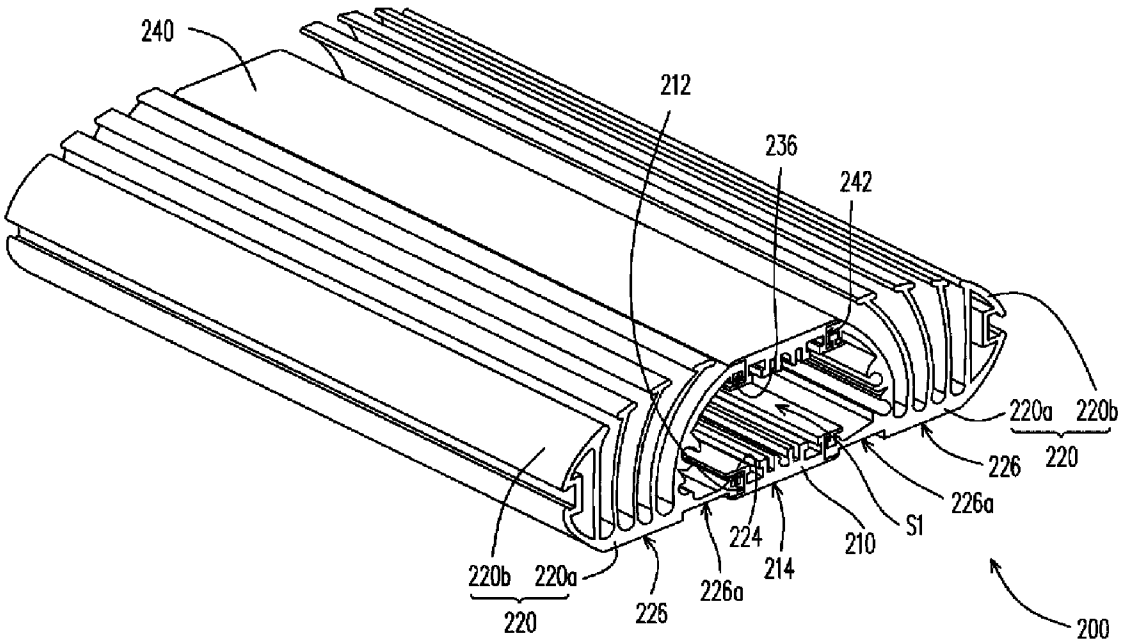
FIG. 2D is a schematic perspective view of the heat dissipation module of the first lighting apparatus in FIG. 2A.

FIG. 1 is a schematic perspective view of a lighting apparatus according to one embodiment of the present disclosure; FIG. 2A is a schematic exploded view of the lighting apparatus in FIG. 1; FIG. 2B is a partially enlarged view of the heat sink of the lighting apparatus in FIG. 2A; FIG. 2C is a partially enlarged view of the first connection element of the lighting apparatus in FIG. 2A; FIG. 2D is a schematic perspective view of the heat dissipation module of the lighting apparatus in FIG. 2A. Referring to FIG. 1 and FIG. 2B at first, in this embodiment, a lighting apparatus 100*a* including a heat dissipation module 200 and a light-emitting diode (LED) module 300 is provided.

To be more specific, with reference to FIG. 2A, FIG. 2B, FIG. 2C and FIG. 2D, the heat dissipation module 200 includes a first connection element 210 and two heat sinks 220. The first connection element 210 and the heat sink 220 of the heat dissipation module 200 are not formed in one piece, and a material of the heat dissipation module 200 is aluminium, for instance. The first connection element 210 has a pair of first sliding connection portions 212 extended alongside two opposite sidewalls of the first connection element 210 and a first lower surface 214 of the first connection element 210. The heat sinks 220 are slidingly disposed at the opposite sidewalls of the first connection element 210. According to this embodiment, each heat sink 220 includes a base 220*a* and a plurality of heat dissipation fins 220*b*. The heat dissipation fins 220*b* of the present embodiment is integrally formed with the corresponding base 220*a* and extend upwardly from the corresponding base 220*a*. However, in other embodiments, the heat dissipation fines 220*b* and the corresponding base 220*a* may be independent components and connected with each other. The base 220*a* has a plurality of openings 222, a second sliding connection portion 224 extended alongside one sidewall of the base 220*a* and a second lower surface 226 of the base 220*a*. Herein, the openings 222 are arranged in array, and the openings 222 are exposed a portion of the heat dissipation fins 220*b*.

The second sliding connection portion 224 of the corresponding base 220*a* engages with the first sliding connection portions 212 of the first connection element 210 so as to make each heat sink 220 slide relative to the first connection element 212 and assembled with the first connection element 212. The second lower surface 226 of the corresponding base 220*a* and the first lower surface 214 of the first connection element 210 are substantially aligned to each other.

It is to be noted that the present disclosure does not limit the implementation structure of the first connection element 210 and the heat sinks 220, although the first connection element 210 herein is implemented by having the first sliding connection portions 212 and the heat sinks 220 herein is implemented by having the second sliding connection portions 224, and the second sliding connection portions 224 are engaging with the first sliding connection portions 212 so as to make the heat sinks 220 slide relatively to the first connection element 210. Any known structure able to have the same fixing effect still falls in the technical scheme adopted by the present disclosure without departing from the scope of the present disclosure. In other words, in other embodiments not shown, anyone skilled in the art can select in their wills the above-mentioned structure according to the application need so as to reach the required technical effect.

The LED module 300 includes a plurality of LED arrays 300*a* and a plurality of lenses (not shown) is mounted on the second lower surfaces 226 of the corresponding bases 220*a* of the corresponding heat sinks 220, as shown in FIG. 2B. In this embodiment, each LED array 300*a* comprises a carrier 310 and a plurality of light-emitting diodes 320 disposed on the carrier 310 and electrically connected to the carrier 310. The lenses respectively cover the corresponding LED arrays 310*b*. It notes that the each lens having a flat portion and a protrusion portion, the flat portion has a rough surface (not shown) surrounding the LEDs 320 so that the lateral light emitted from the LEDs of each LED array 310*a* is uniformly diffused through the rough surface. In addition, with reference to FIGS. 2B and 2C, the second lower surfaces 226 of the corresponding bases 220*a* respectively have a recess 226*a*, and the LED arrays 300*a* are respectively disposed in the recess 226*a*.

Particularly, an air channel 232 exists between any two adjacent heat dissipation fins 220*b* and communicates with the openings 222. Furthermore, according to this embodiment, referring to the FIG. 2B, an interval 234 exists between any two adjacent heat dissipation fins 220*b*, and a width of the interval 234 between any two adjacent heat dissipation fins 220*b* from closer to the corresponding bases 220*a* towards farther from the corresponding bases 220*a* is not a constant. For example, preferably, the width of the interval 234 farther from the corresponding bases 220*a* is larger than that of the interval closer to the corresponding bases 220*a*, so that the thermal-convection of the air can be accelerated to dissipate the heat generated by the LED module 300 located at the second lower surfaces 226 of the bases 220*a*. In addition, the air channels 232 are quite long so that the efficiency of the thermal convection can be elevated due to the "stack effect". Since the air channel 232 exists between any two adjacent heat dissipation fins 220*b* and communicates with the openings 222 of the base 220*a*, the heat generated by the LED module 300 is firstly transmitted to the base 220*a* of the heat sinks 220 and then quickly transferred to the heat dissipation fins 220*b* for dissipation into the ambient air. The air inside the air channel 232 is heated by the heat dissipation fins 220*b* and being discharged to the outside through the air channel 232. At this time, outside cool ambient air is entered into the air channel 232 through the openings 222. Therefore, the heat from the LED module 300 is dissipated by natural convection through opening 222 and the air channel 232. The heat generated from the LED module 300 is dissipated by thermal-conduction and thermal-convection. As a result, the heat dissipation efficiency of the lighting apparatus 100*a* is improved.

Note that the first sliding connection portions 212 of the first connection element 210 are sliding rails and the second sliding connection portions 224 of the corresponding heat sinks 220 are sliding grooves according to the present embodiment. However, the present embodiment does not limit the types of the first sliding connection portions 212 and the second sliding connection portions 224. In another embodiment, the first sliding connection portions 212 may be sliding grooves and the second sliding connection portions 224 may be sliding rails, which still belong to a technical choice adoptable in the present embodiment and fall within the protection scope of the present embodiment. In addition to the above embodiments, the present disclosure may be embodied in other fashions, as long as the first sliding connection portions 212 are respectively engaged with the second sliding connection portions 224, the applications and variations of which should be known to those of ordinary skill in the art and is thus not described herein.

Referring to FIG. 2A and FIG. 2D, in this embodiment, the heat dissipation module 200 further includes a second connection element 240 disposed above the first connection element 210 and having a pair of third sliding connection portions 242 extended alongside two opposite sidewalls of the second connection element 240. In one embodiment, the structure of the second connection element 240 and the structure of the first connection element 210 are substantially the same in structure. In addition, one of the heat dissipation fins 220*b* of each heat sink 220 closer to the second first connection element 240 further includes a fourth sliding connection portion 236. The fourth sliding connection portion 236 engages with one of the third sliding connection portions 242 so as to make each heat sink 220 slide relative to the second connection element 240 and assemble with the second connection element 240.

Note that the third sliding connection portions 242 of the second connection element 240 are sliding rails and the fourth sliding connection portions 236 of the corresponding heat sinks 220 are sliding hooks according to the present embodiment. However, the present embodiment does not limit the types of the third sliding connection portions 242 and the fourth sliding connection portions 236. In another embodiment, the third sliding connection portions 242 may be sliding hooks and the fourth sliding connection portions 236 may be sliding rails, which still belong to a technical choice adoptable in the present embodiment and fall within the protection scope of the present embodiment. In addition to the above embodiments, the present disclosure may be embodied in other fashions, as long as the third sliding connection portions 242 are respectively engaged with the fourth sliding connection portions 236, the applications and variations of which should be known to those of ordinary skill in the art and is thus not described herein.

Figure 3:
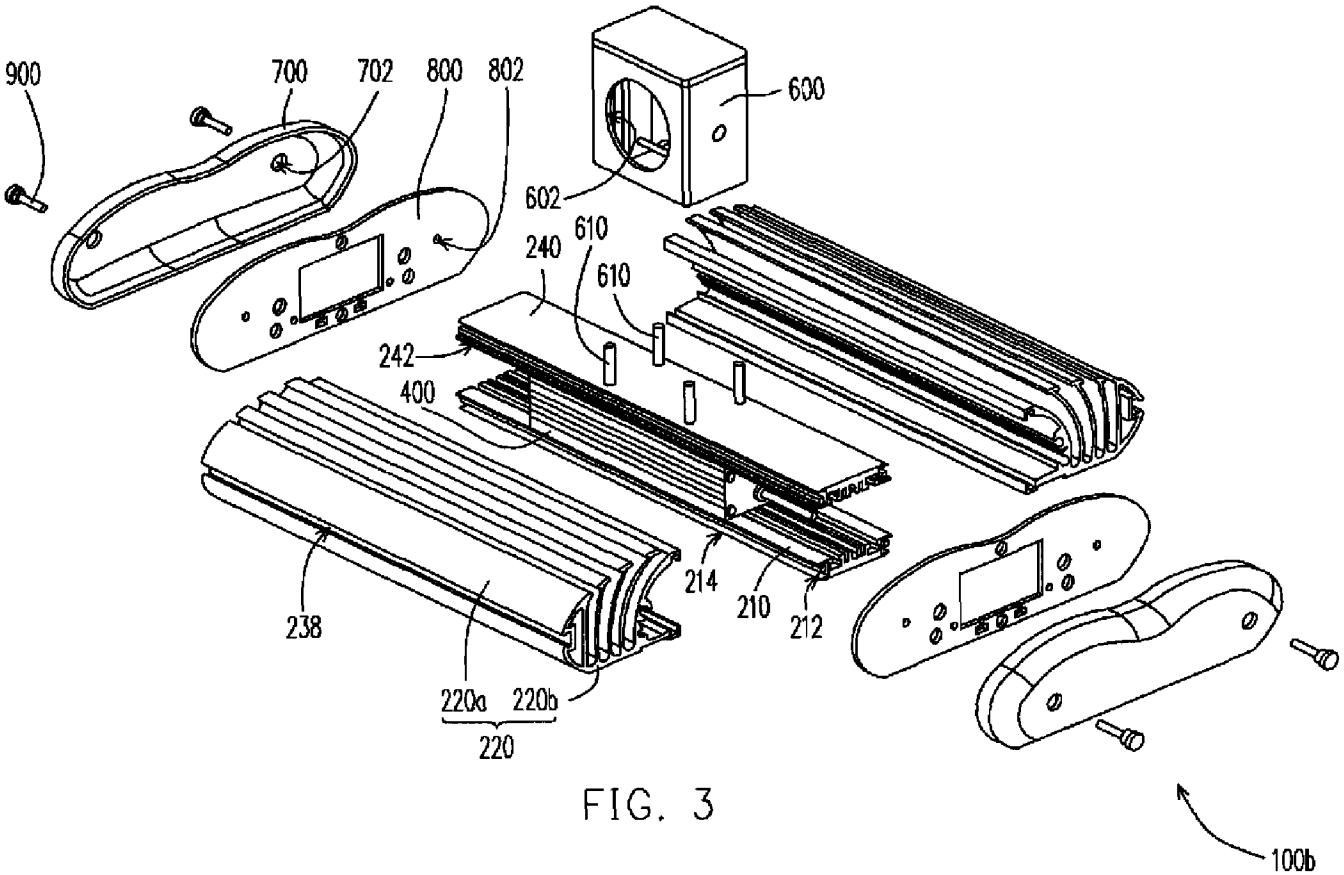
FIG. 3 is a schematic exploded view of a second lighting apparatus according to another embodiment of the present disclosure.
Figure 4:
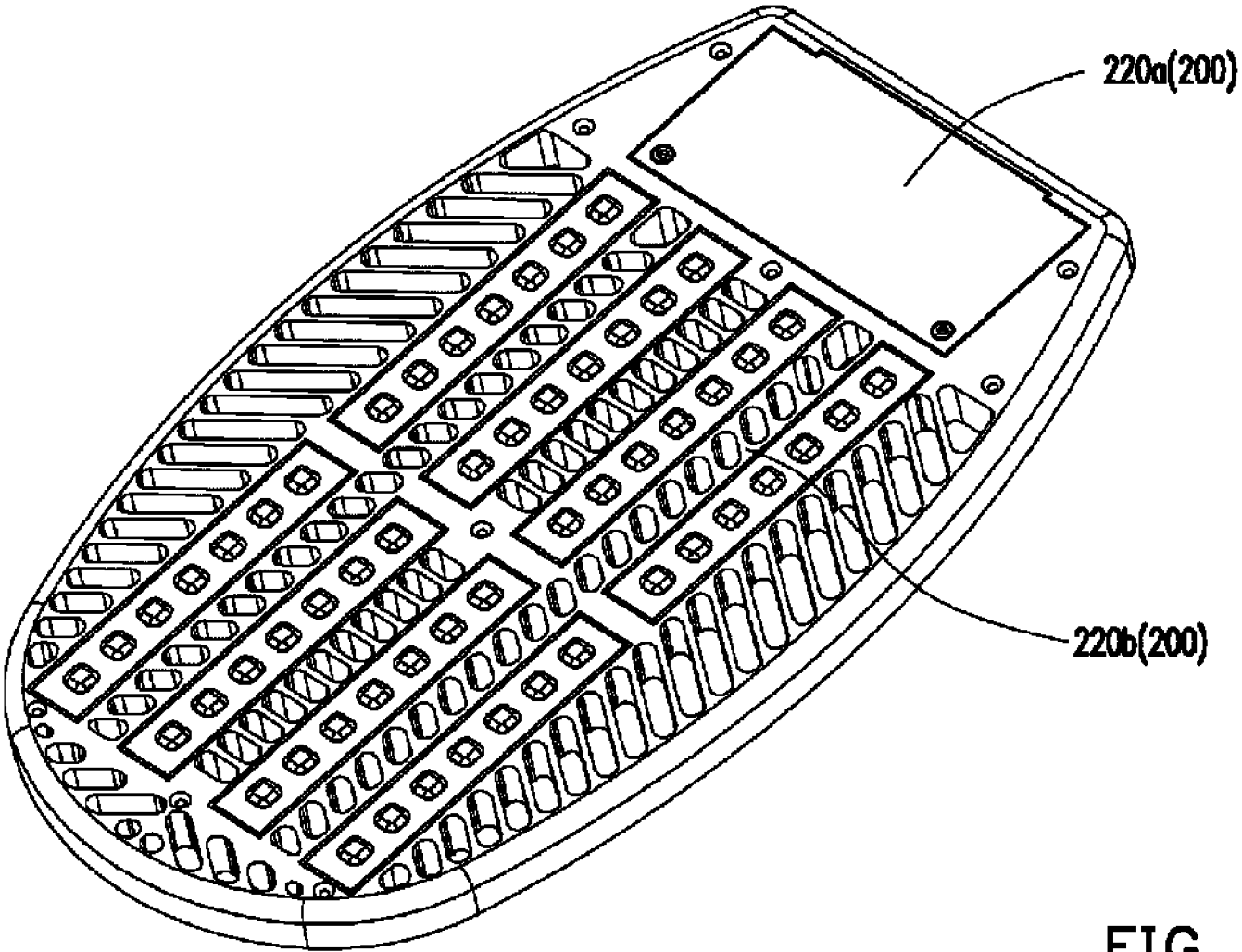
FIG. 4 is an image figure of the heat dissipation module according to a further embodiment of the present disclosure.

It is noted that, in this embodiment, with reference to FIG. 2B and FIG. 2D, the heat dissipation fins 220*b* of the heat sinks 220 extend upwardly from the corresponding base 220*a* and bend toward a space above the first connection element 210. Moreover, the heat sinks 220, the first connection element 210 and the second connection element 220 form a first containing space S1. The lighting apparatus 100*a* of the present embodiment further includes a power supply 400 slidingly disposed in the first containing space S1 and located between the first connection element 210 and the second connection element 240, as shown in FIG. 3, for supplying power to drive the lighting apparatus 100*a*. However, in other embodiment, the heat dissipation fins 220*b* can also extend upwardly from the base 220*a* and bend toward a space far from above the first connection element 210 or just extend upwardly form the base 220*a*. Furthermore, the present embodiment does not limit the types of the heat dissipation fins 220*b*, although the heat dissipation fins 220*b* of the heat sinks 220 are substantially symmetry. In addition to the above embodiments, the heat sink 220 of the present disclosure may be embodied in other fashions. As shown in FIG. 4, the heat sink 200 includes a base 220*a* and the heat dissipation fins 220*b*. The heat dissipation fins 220*b* are disposed on the base 220*a*, and the heat dissipation fins 220*b* of the present embodiment may integrally formed with the corresponding base 220*a*. an air channel exists between any two adjacent heat dissipation fins 220*b*. The difference between this embodiment and others is that the heat dissipation fins 220*b* extended toward a direction may extend horizontally from the base 220*a*.

Furthermore, referring to FIG. 1 and FIG. 2A, in this embodiment, the lighting apparatus 100*a* further includes a protecting cover 500 having a plurality of sliding hooks 530 at the sides of the protecting cover 500. Herein, the protecting cover 500 can avoid the dust falling into the heat dissipation module 200 and has a main plate 510 and a side plate 520 disposed around the main plate 510 and connected to the main plate 510. To be more specific, one of the heat dissipation fins 220*b* of each heat sink 220 farthest from the first connection element 210 includes a sliding rail 238, and the sliding hooks 530 respectively lock the sliding rails 238 so as to make the protecting cover 500 slide relative to the heat dissipation module 200.

Particularly, the main plate 510, the side plate 520 and the heat dissipation fins 220*b* of the heat sinks 220 form a second containing space S2. The main plate 510 of the protecting cover 500 has an opening 512, and the side plate 520 of the protecting cover 500 has a plurality of gas circulation holes 522. The heat generated by the LED module 300 can be dissipated from the openings 222 of the base 220*a* to the outside environment sequentially through the air channels 232, the gas circulation holes 522 and the opening 512. Since the heat generated by the LED module 300 is dissipated by thermal-conduction and thermal-convection, the heat of the LED modules 300 is discharged and the heat dissipation efficiency of the lighting apparatus 100*a* is advanced.

Moreover, the lighting apparatus 100*a* in the present embodiment further includes two side covers 700, two side sealing slices 800 and a plurality of fasteners 900, as shown in FIG. 1 and FIG. 2A. The side covers 700 respectively overlay two ends of the heat dissipation module 200, wherein the side covers 700 respectively have a plurality of first fastening holes 702. The side sealing slices 800 are respectively located between the side covers 700 and the ends of the heat dissipation module 200. The side sealing slices 800 respectively have a plurality of second fastening holes 802 respectively corresponding to the first fastening holes 702. The fasteners 900 are suitable to go through the first fastening holes 702 and the second fastening holes 802 to fasten the side covers 700 on the heat dissipation module 200. As a result, the lighting apparatus 100*a* has a compact structure and is better at preventing dust falling into the heat dissipation module 200. In addition, the fasteners 900 include screws or bolts, for instance. In addition, one of the side sealing slices 800 has an opening 804 respectively, and the power supply 400 can be slidingly disposed in the first containing space S1 by an additional bracket 410 passing through the opening 804 of the corresponding sealing slices 800.

Figure 5:
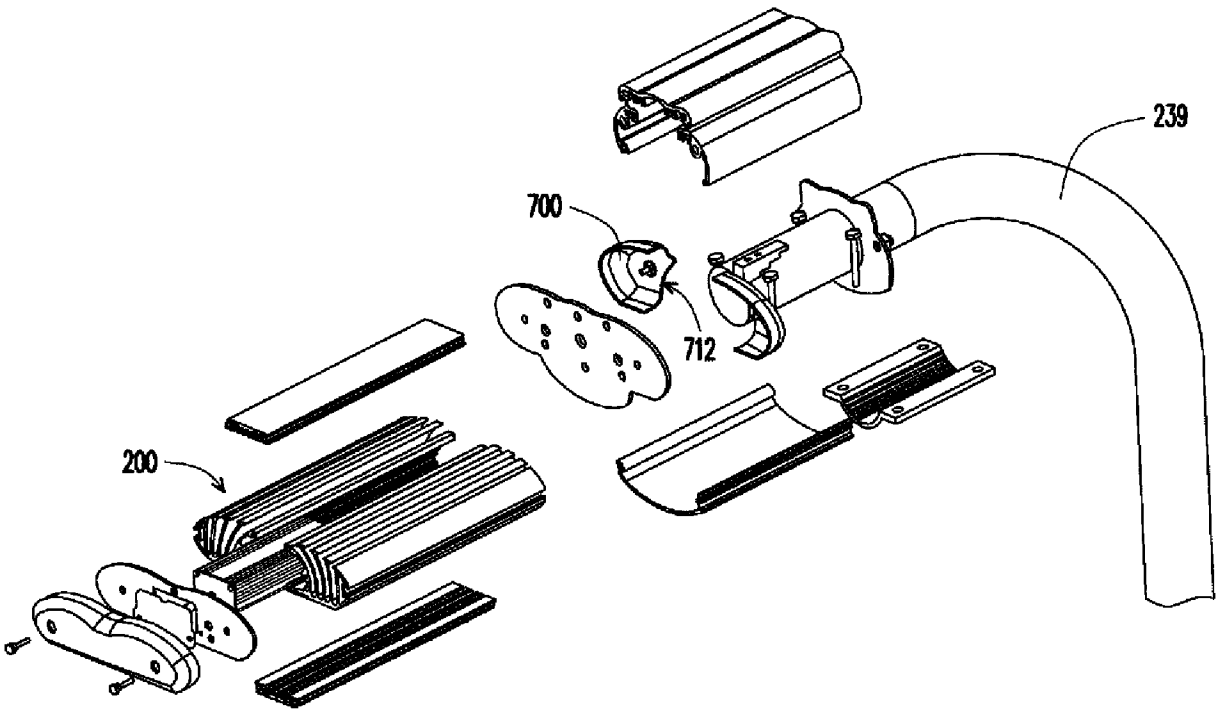
FIG. 5 is an image figure of a lighting apparatus according to a further embodiment of the present disclosure.

FIG. 3 is a schematic exploded view of a lighting apparatus according to another embodiment of the present disclosure. Referring to FIG. 3, the element having the same numbers or names of the lighting apparatus 100*a* in FIG. 2A have identical functions and working principles. The difference between the lighting apparatus 100*b* of this embodiment and that of the above-mentioned embodiment is that lighting apparatus 100*b* does not include the protecting cover 500. The lighting apparatus 100*b* in the present embodiment further includes a supporting element 600 and a plurality of additional rods 610, wherein the supporting element 600 is disposed on the second connection element 240 and has an accommodating opening 602 for containing an object, such as a fixing element, as not shown. The additional rods 610 are disposed on the second connection element 240 for supporting and fixing the supporting element. Note that the opening 512, 602 are not limited to form on the protective cover 520 or supporting element 600. As shown in FIG. 5, an opening 712 may be formed on the side cover 700 for containing an object, such as a shaft 239.

Figure 6A:
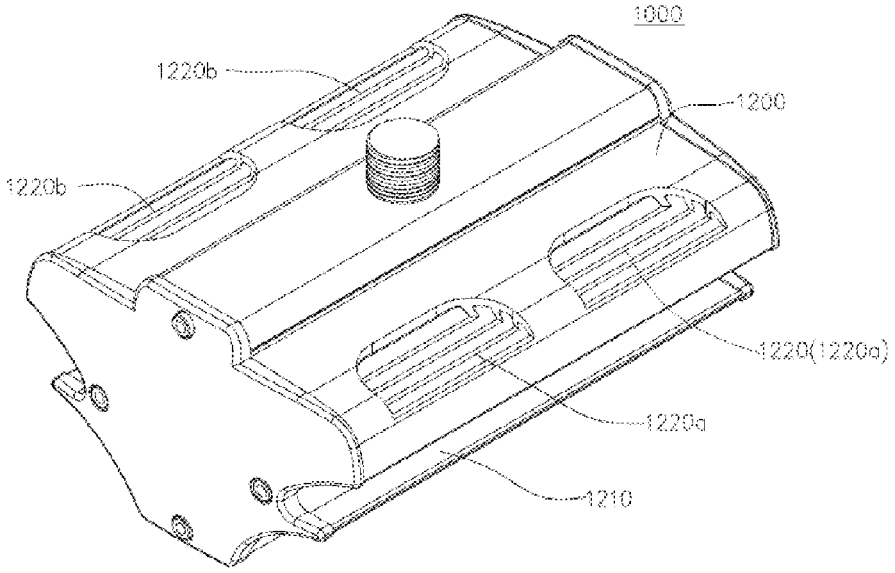
FIG. 6A is a first schematic perspective view of a third lighting apparatus according to one embodiment of the present disclosure.
Figure 6B:
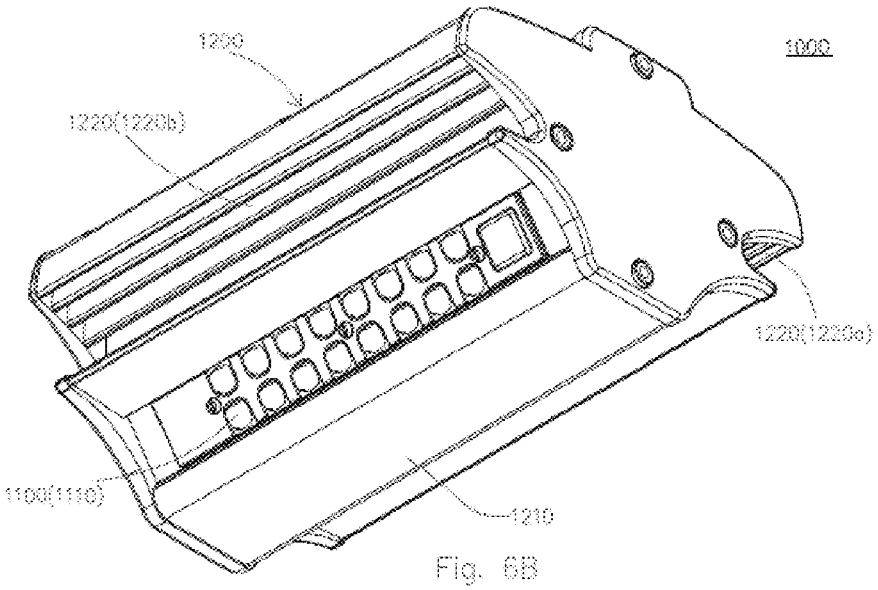
FIG. 6B is a second schematic perspective view of the third lighting apparatus of FIG. 6A.
Figure 6C:
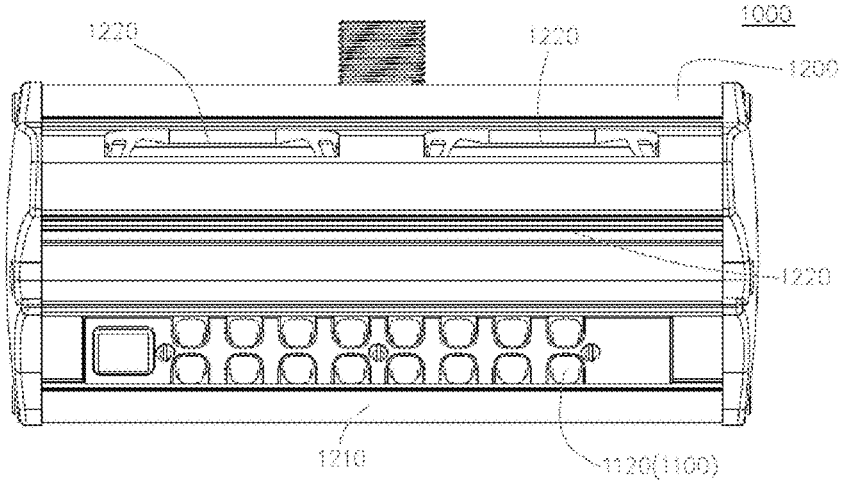
FIG. 6C is a third schematic perspective view of the third lighting apparatus according of FIG. 6A.
Figure 6D:
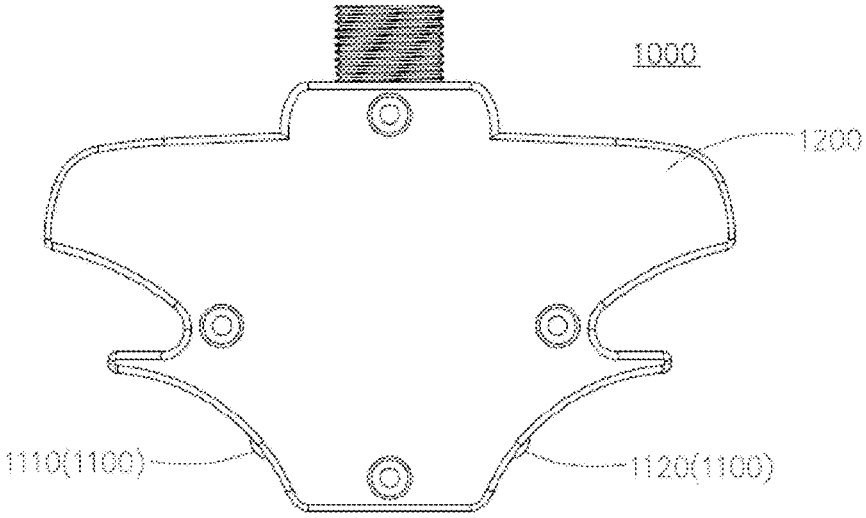
FIG. 6D is a side view of the third lighting apparatus of FIG. 6A.
Figure 6E:
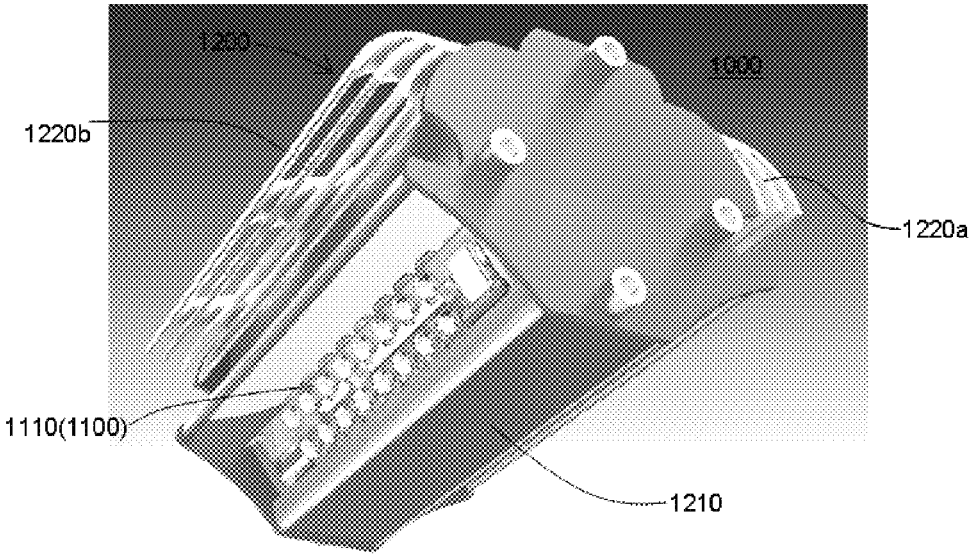
FIG. 6E is an end view of the third lighting apparatus of FIG. 6A.
Figure 6F:
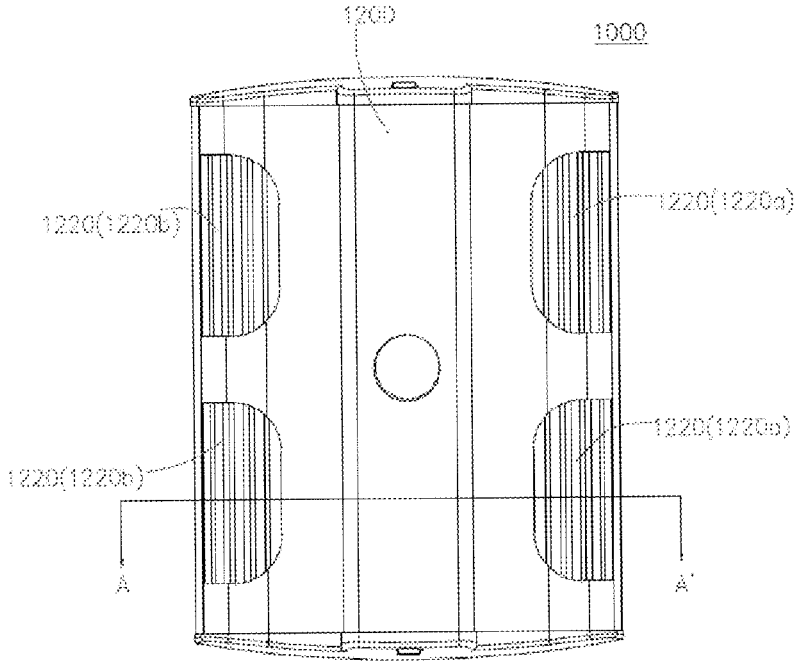
FIG. 6F is a top view of the third lighting apparatus of FIG. 6A.
Figure 6G:
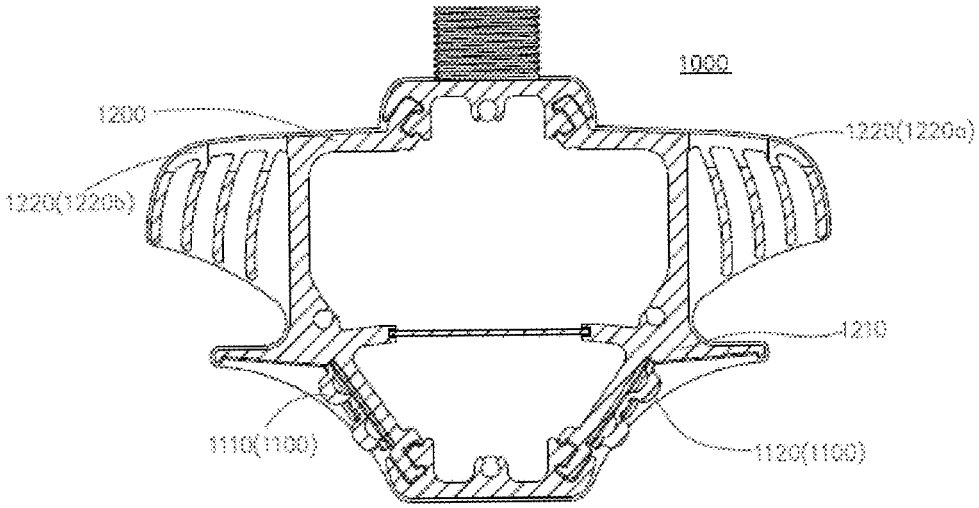
FIG. 6G is a cross-sectional view of the third lighting apparatus of FIG. 6A.
Figure 6H:
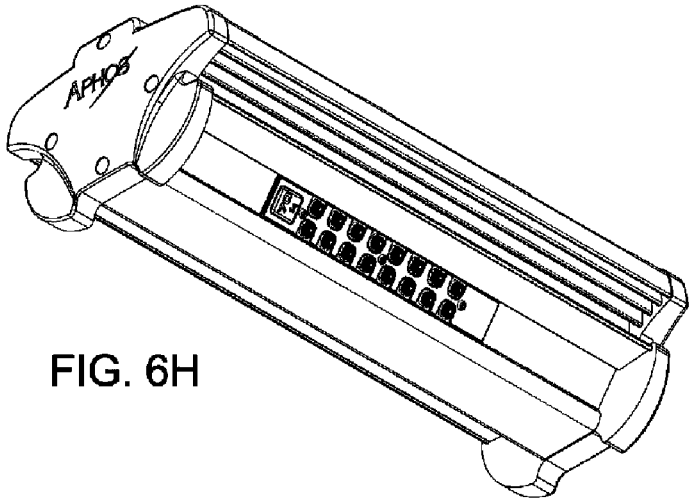
FIG. 6H is a schematic perspective view of a third lighting apparatus according to another embodiment of the present disclosure.
Figure 6I:
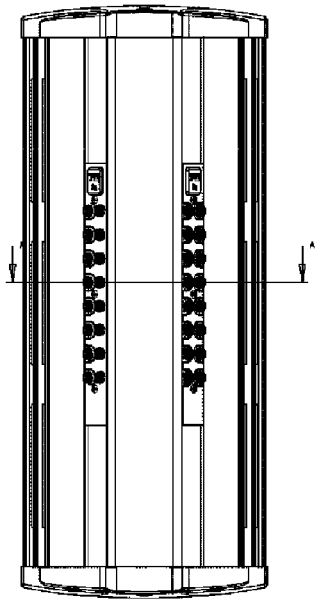
FIG. 6I is a bottom view of the third lighting apparatus of FIG. 6H.
Figure 6J:
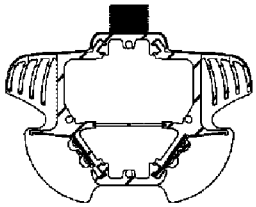
FIG. 6J is a cross-sectional view of the third lighting apparatus of FIG. 6H.
Figure 6K:
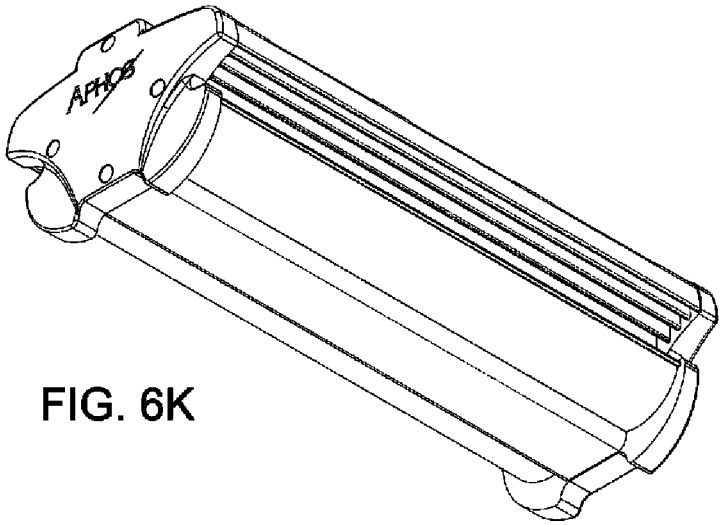
FIG. 6K is a schematic perspective view of a third lighting apparatus according to yet another embodiment of the present disclosure.
Figure 6L:
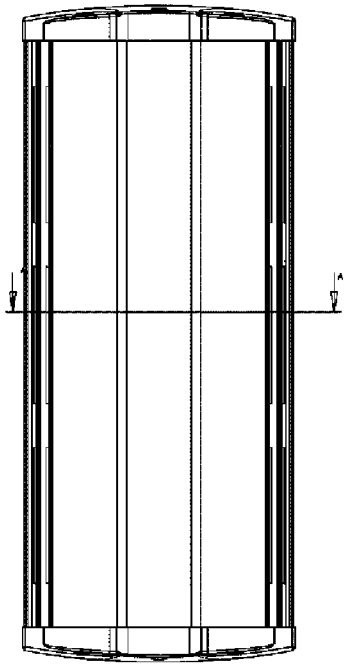
FIG. 6L is a bottom view of the third lighting apparatus of FIG. 6K.
Figure 6M:
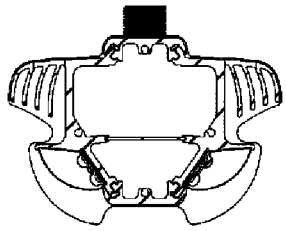
FIG. 6M is a cross-sectional view of the third lighting apparatus of FIG. 6K.
Figure 6N:
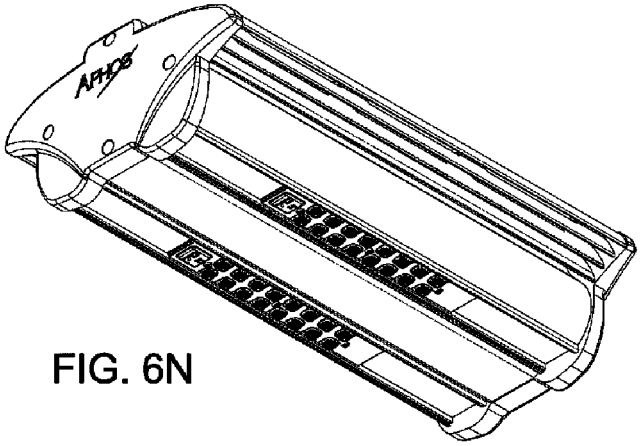
FIG. 6N is a schematic perspective view of a third lighting apparatus according to yet another embodiment of the present disclosure.
Figure 6O:
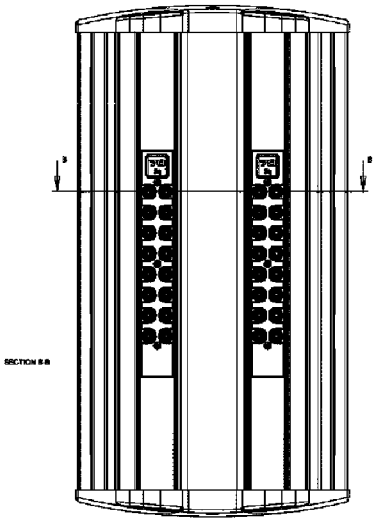
FIG. 6O is a bottom view of the third lighting apparatus of FIG. 6N.
Figure 6P:
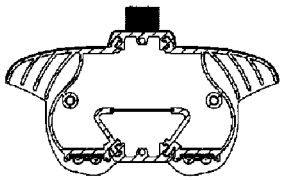
FIG. 6P is a cross-sectional view of the third lighting apparatus of FIG. 6N.
Figure 6Q:
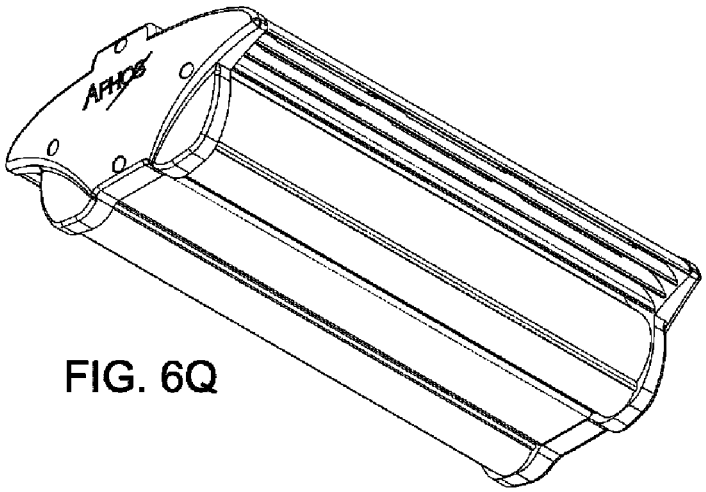
FIG. 6Q is a schematic perspective view of a third lighting apparatus according to yet another embodiment of the present disclosure.
Figure 6R:
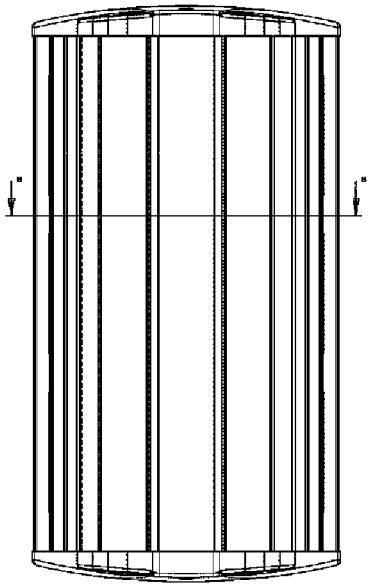
FIG. 6R is a bottom view of the third lighting apparatus of FIG. 6Q.
Figure 6S:
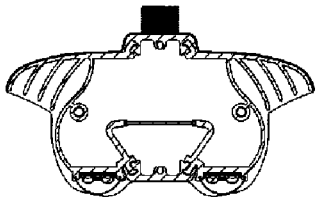
FIG. 6S is a cross-sectional view of the third lighting apparatus of FIG. 6Q.
Figure 6T:
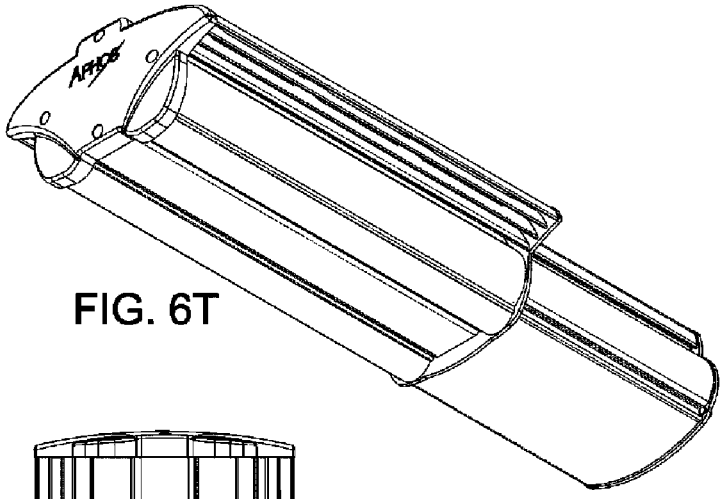
FIG. 6T is a schematic perspective view of a third lighting apparatus according to yet another embodiment of the present disclosure.
Figure 6U:
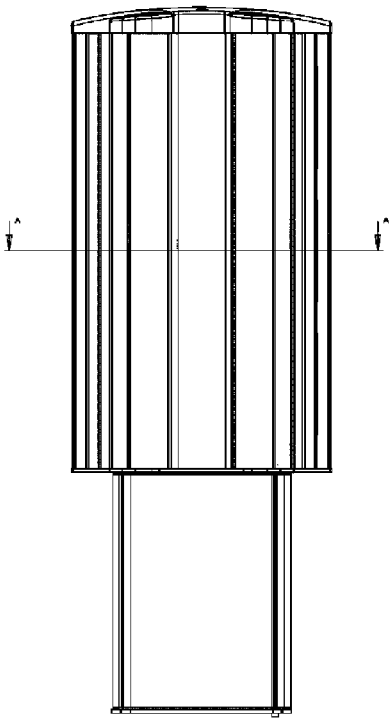
FIG. 6U is a bottom view of the third lighting apparatus of FIG. 6T.
Figure 6V:
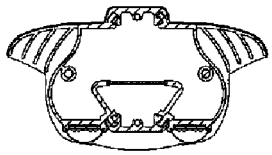
FIG. 6V is a cross-sectional view of the third lighting apparatus of FIG. 6T.

FIGS. 6A-6V illustrate the various views of an embodiment of a lighting apparatus 1000. The following description is provided with reference to one or more of FIGS. 6A-6V.

In this embodiment, the lighting apparatus 1000 includes a light source module 1100 that emits light and generates heat, and a heat dissipation module 1200 that dissipates at least a portion of the heat. In one embodiment, the light source module 1000 includes one or more LEDs. In alternative embodiments, the light source module 1000 may include light source other than LEDs based on a different light emission technology.

The heat dissipation module 1200 includes a base portion 1210 to which the light source module 1100 is physically coupled or otherwise fastened. The heat dissipation module 1200 also includes a plurality of heat dissipation fins 1220. The fins 1220 are configured to achieve certain functions. For example, when the light source module 1100 is physically coupled to the base portion 1210 to be at least partially vertically below the heat dissipation module with respect to a horizontal plane, at least a portion of the heat is transferred vertically to at least one of the fins 1220 through the base portion 1210. Moreover, at least two of the fins 1220 that are immediately adjacent to one another form an air channel having a first opening and a second opening between those two fins. The air channel has a generally decreasing cross-sectional area with respect to air rising up the air channel in a generally vertical direction with respect to the horizontal plane as the air enters the air channel through the first opening and exits the air channel through the second opening.

In one embodiment, a first number of the fins 1220*a* are on a first primary side of the heat dissipation module 1200 and a second number of the fins 1220*b* are on a second primary side of the heat dissipation module 1200. The light source module 1100 includes a first light source 1110 and a second light source 1120. The first light source 1110 is physically coupled to the base portion 1210 in a position substantially vertically below the first number of the fins 1220*a* with respect to the horizontal plane and the second light source 1120 is physically coupled to the base portion 1210 in a position substantially vertically below the second number of the fins 1220*b* with respect to the horizontal plane when the lighting apparatus 1000 is in operation. For example, as shown in FIGS. 6A-6V, biaxial symmetric lighting can be achieved with such orientation for the various light sources, such as LEDs.

In one embodiment, at least one of the fins 1220 is at least partially curved in shape. Alternatively, each of the fins 1220 is at least partially curved in shape. In one embodiment, the fins 1220 are configured such that a respective air channel having a respective first opening and a respective second opening is formed between every two immediately adjacent fins and between one of the fins and the base portion. Each air channel may have a generally decreasing cross-sectional area with respect to air rising up the respective air channel as the air enters the respective air channel through the respective first opening and exits the respective air channel through the respective second opening.

In one embodiment, the heat dissipation module 1200 has a heat dissipation capacity at least in a range between 8 watts/lb and 10 watts/lb. In operation, the capacity may be around 8 watts/lb, for example.

In one embodiment, the light source module 1100 is physically coupled to the heat dissipation module 1200 to emit light in an angle that is between a substantially horizontal angle and a substantially vertical angle with respect to the horizontal plane when the lighting apparatus 1000 is in operation. For example, when the lighting apparatus 1000 is mounted on a post or fixture for parking lot lighting, light from the light source module 1100 may be emitted approximately in an angle 45 degrees toward the ground and generally between 0 degree and 90 degrees toward the ground. This will result in a well-illuminated parking lot with no negative effect such as glare in the eyes for drivers in the parking lot due to the light emitted by the light source module 1100.

In another embodiment, the light source module 1100 is physically coupled to the heat dissipation module 1200 to emit light in an angle that is substantially perpendicular to the horizontal plane when the lighting apparatus 1000 is in operation. For example, when the lighting apparatus 1000 is mounted on a post or fixture, light from the light source module 1100 may be downward facing toward the ground.

The heat dissipation module is made of a thermally conductive material, such as aluminium, magnesium, copper, or conductive plastic, for example.

In one embodiment, the lighting apparatus may further include one or more diffusers, as shown in FIGS. 6K-6M and 6Q-6V. The diffuser diffuses at least a portion of the light emitted by the light source module.

In one embodiment, the lighting apparatus may further include a mounting apparatus, as shown in FIGS. 6T and 6U. The mounting apparatus facilitates physically coupling the lighting apparatus to a fixture.

In one embodiment, the lighting apparatus may further include a guard piece, as shown in FIGS. 6H-6M. The guard piece prevents the light emitted by the light source module from shining toward at least one direction.

Figure 7:
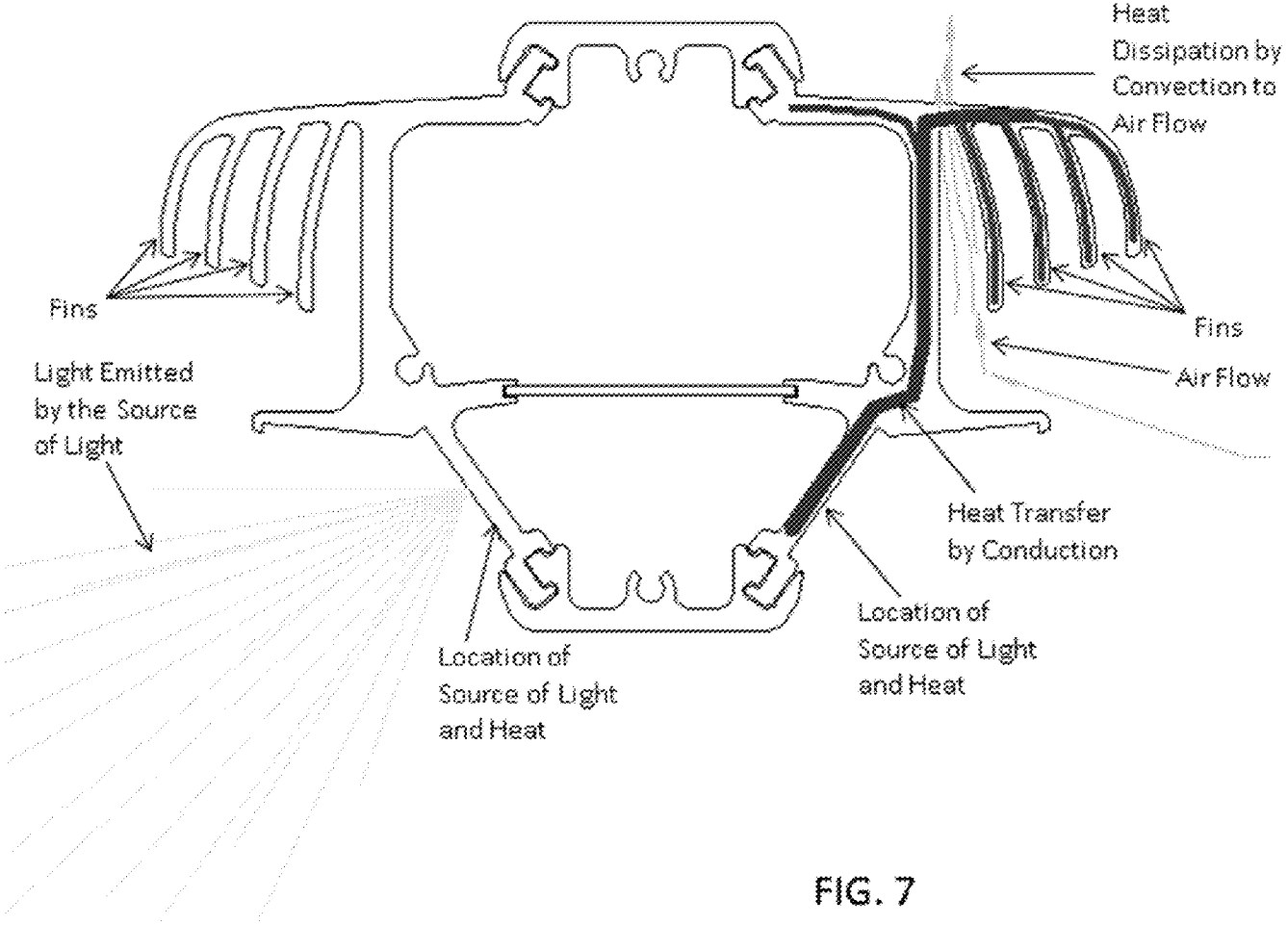
FIG. 7 is cross-sectional view of the third lighting apparatus in operation according to the present disclosure.

In one embodiment, heat dissipation module 1200 may have one or more features to allow the lighting apparatus 1000 to be physically coupled, or otherwise fastened, to a wall or fixture such as a light pole. For example, the heat dissipation module 1200 may have a threaded stub protruding from a surface of the heat dissipation module 1200 to allow the lighting apparatus 1000 to be physically coupled to a fixture in a screw-on fashion. Alternatively, the lighting fixture may have a mounting appara FIG. 7 is cross-sectional view of the lighting apparatus 1100 in operation according to the present disclosure. As shown in FIG. 7, heat is transferred from the light source module 1100 to the heat dissipation module 1200 via vertical heat transfer as opposed to horizontal heat transfer. This avoids heat saturation issue encountered by designs with horizontal heat transfer via heat conduction through a thermally conductive material.

Additionally, the heat dissipation fins of the heat dissipation module 1200 form air channels that have a decreasing cross-sectional areal as air rises up the air channels. In one embodiment, most or all of the fins are curved in shape. The heat-absorbing air is compressed as it rises up the air channels with the Bernoulli's principle and Venturi effect at work. This causes a spiral effect, or turbulence, in the air to result in enhanced efficiency in cooling without the need of an active cooler, such as a fan, or need of energy to power such active cooler. Firstly, there is more linear effect in cooling, giving more predicted cooling and better heat transfer via convection to the air. For example, empirical data shows that better cooling can be achieved with the proposed design at 45 degrees centigrade. Secondly, the proposed design allows effective cooling with less mass of the heat dissipation module 1200. In general, with conventional design, a typical heat dissipation module has a heat dissipation capacity of 3 watts/lb. In contrast, empirical data shows that the proposed design can achieve a heat dissipation capacity of at least 8 watts/lb in normal operation and up to 10 watts/lb.

Based on the above, the lighting apparatus of the present disclosure has heat dissipation fins extending upwardly from the base, and an air channel that exists between any two adjacent heat dissipation fins which communicates with the openings of the base. Consequently, the heat generated by the LED module disposed on the lower surface of the base can be dissipated by thermal-conduction and thermal-convection. Furthermore, since the interval between any two adjacent heat dissipation fins from closer to the base towards farther from the base is not a constant, the thermal-convection of the air can be accelerated to dissipate the heat generated by the LED module. As a result, the heat dissipation efficiency of the lighting apparatus is improved.

It will be apparent to those skilled in the art that various modifications and variations can be made to the structure of the present disclosure without departing from the scope or spirit of the present disclosure. In view of the foregoing, it is intended that the present disclosure cover modifications and variations of this present disclosure provided they fall.

What is claimed is:

1. A lighting apparatus, comprising:

a light source module that emits light and generates heat; and a heat dissipation module that dissipates at least a portion of the heat, the heat dissipation module comprising:

a base portion to which the light source module is physically coupled; and a plurality of heat dissipation fins, at least two of the fins that are immediately adjacent to one another forming an air channel having a first opening and a second opening between the at least two of the fins, the air channel having a generally decreasing cross-sectional area with respect to air rising up the air channel in a generally vertical direction with respect to a horizontal plane as the air enters the air channel through the first opening and exits the air channel through the second opening.

2. The lighting apparatus as recited in claim 1, wherein when the light source is physically coupled to the base portion to be at least partially vertically below the heat dissipation module with respect to the horizontal plane, at least a portion of heat generated by the light source is transferred vertically to at least one of the fins through the base portion.

3. The lighting apparatus as recited in claim 1, wherein the light source module is physically coupled to the heat dissipation module to emit light in an angle that is between a substantially horizontal angle and a substantially vertical angle with respect to the horizontal plane when the lighting apparatus is in operation.

4. The lighting apparatus as recited in claim 1, wherein the light source module is physically coupled to the heat dissipation module to emit light in an angle that is substantially perpendicular to the horizontal plane when the lighting apparatus is in operation.

5. The lighting apparatus as recited in claim 1, wherein the light source module comprises at least one light-emitting diode (LED).

6. The lighting apparatus as recited in claim 1, wherein at least one of the fins is at least partially curved in shape.

7. The lighting apparatus as recited in claim 1, wherein the fins are configured such that a respective air channel having a respective first opening and a respective second opening is formed between every two immediately adjacent fins and between one of the fins and the base portion, each air channel having a generally decreasing cross-sectional area with respect to air rising up the respective air channel as the air enters the respective air channel through the respective first opening and exits the respective air channel through the respective second opening.

8. The lighting apparatus as recited in claim 1, wherein the heat dissipation module has a heat dissipation capacity at least in a range between 8 watts/lb and 10 watts/lb.

9. The lighting apparatus as recited in claim 1, wherein the heat dissipation module is made of aluminium, magnesium, copper, conductive plastic, or a thermally conductive material.

10. The lighting apparatus as recited in claim 1, further comprising:

a diffuser that diffuses at least a portion of the light emitted by the light source module.

11. The lighting apparatus as recited in claim 1, further comprising:

a mounting apparatus that facilitates physically coupling the lighting apparatus to a fixture.

12. The lighting apparatus as recited in claim 1, further comprising:

a guard piece that prevents the light emitted by the light source module from shining toward at least one direction.

13. A heat dissipation module, comprising:

a base portion to which at least a portion of heat generated by a light source is transferred when the light source is physically coupled to the base portion; and a plurality of heat dissipation fins, at least two of the fins that are immediately adjacent to one another forming an air channel having a first opening and a second opening between the at least two of the fins, the air channel having a generally decreasing cross-sectional area with respect to air rising up the air channel in a generally vertical direction with respect to a horizontal plane as the air enters the air channel through the first opening and exits the air channel through the second opening.

14. The heat dissipation module as recited in claim 13, wherein when the light source is physically coupled to the base portion to be at least partially vertically below the heat dissipation module with respect to the horizontal plane, at least a portion of the heat generated by the light source is transferred vertically to at least one of the fins through the base portion.

15. The heat dissipation module as recited in claim 13, wherein at least one of the fins is at least partially curved in shape.

16. The heat dissipation module as recited in claim 13, wherein the fins are configured such that a respective air channel having a respective first opening and a respective second opening is formed between every two immediately adjacent fins and between one of the fins and the base portion, each air channel having a generally decreasing cross-sectional area with respect to air rising up the respective air channel as the air enters the respective air channel through the respective first opening and exits the respective air channel through the respective second opening.

17. The heat dissipation module as recited in claim 13, wherein the heat dissipation module has a heat dissipation capacity at least in a range between 8 watts/lb and 10 watts/lb.

18. The heat dissipation module as recited in claim 13, wherein the heat dissipation module is made of aluminium, magnesium, copper, conductive plastic, or a thermally conductive material.

19. A lighting apparatus, comprising:

a light source module that emits light and generates heat; and a heat dissipation module that dissipates at least a portion of the heat, the heat dissipation module comprising:

a base portion to which the light source module is physically coupled; and a plurality of heat dissipation fins configured such that:

when the light source module is physically coupled to the base portion to be at least partially vertically below the heat dissipation module with respect to a horizontal plane, at least a portion of the heat is transferred vertically to at least one of the fins through the base portion, at least two of the fins that are immediately adjacent to one another form an air channel having a first opening and a second opening between the at least two of the fins, the air channel having a generally decreasing cross-sectional area with respect to air rising up the air channel in a generally vertical direction with respect to the horizontal plane as the air enters the air channel through the first opening and exits the air channel through the second opening;

wherein:

a first number of the fins are on a first primary side of the heat dissipation module and a second number of the fins are on a second primary side of the heat dissipation module;

the light source module comprises a first light source and a second light source, the first light source being physically coupled to the base portion in a position at least partially vertically below the first number of the fins with respect to the horizontal plane and the second light source being physically coupled to the base portion in a position at least partially vertically below the second number of the fins with respect to the horizontal plane when the lighting apparatus is in operation;

at least one of the fins is at least partially curved in shape;

the light source module comprises at least one light-emitting diode (LED).

20. The lighting apparatus as recited in claim 19, wherein the heat dissipation module has a heat dissipation capacity at least in a range between 8 watts/lb and 10 watts/lb.

* * * * *